United States Patent [19]

Etnyre et al.

[11] 4,427,376

[45] Jan. 24, 1984

[54] APPARATUS FOR HEATING AGGREGATE, RECYCLED ASPHALT AND THE LIKE

[75] Inventors: Robert E. Etnyre, Oregon, Ill.; William H. Wylie, El Reno, Okla.

[73] Assignee: Wylie Manufacturing Company, Oregon, Ill.

[21] Appl. No.: 398,778

[22] Filed: Jul. 16, 1982

[51] Int. Cl.[3] ..... F27B 7/36; B28C 1/22

[52] U.S. Cl. ..... 432/105; 432/110; 432/111; 432/114; 366/25

[58] Field of Search ..... 432/105, 118, 107, 108, 432/110, 111, 112–114; 366/25

[56] References Cited

U.S. PATENT DOCUMENTS

| | | | |
|---|---|---|---|
| 1,332,137 | 2/1920 | Newhouse . | |
| 1,810,476 | 6/1931 | Harty et al. | 432/114 |
| 2,057,099 | 10/1936 | Ingraham | 432/114 |
| 2,207,987 | 7/1940 | Kent et al. | 432/114 |
| 2,487,887 | 11/1949 | McEachran | 259/161 |
| 2,488,653 | 11/1949 | Andree et al. | 432/112 |
| 2,703,704 | 3/1955 | Wylie | 259/157 |
| 3,025,611 | 3/1962 | Preeman | 432/111 |
| 3,407,511 | 10/1968 | Camm | 432/110 |
| 3,780,447 | 12/1973 | Fales | 432/108 |
| 3,798,789 | 3/1974 | Thompson | 432/110 |
| 3,832,201 | 8/1974 | Shearer | 106/281 |
| 4,025,057 | 5/1977 | Shearer | 259/154 |
| 4,089,508 | 5/1978 | Anderson | 366/7 |
| 4,130,364 | 12/1978 | Brown | 366/4 |
| 4,165,184 | 8/1979 | Schlarmann | 366/12 |
| 4,175,335 | 11/1979 | Avri | 432/114 |
| 4,205,458 | 6/1980 | Austin | 34/134 |
| 4,229,109 | 10/1980 | Benson | 366/24 |
| 4,249,890 | 2/1981 | Graham | 432/13 |
| 4,260,368 | 4/1981 | Karlsson | 432/113 |
| 4,300,837 | 11/1981 | Malbrunot | 366/25 |
| 4,318,619 | 3/1982 | Schlarmann | 366/4 |
| 4,318,620 | 3/1982 | Malipier et al. | 366/25 |

*Primary Examiner*—Henry C. Yuen

*Attorney, Agent, or Firm*—Leydig, Voit, Osann, Mayer & Holt, Ltd.

[57] ABSTRACT

A drum-type drier and/or mixer in which particulate material such as aggregate or recycled asphalt is introduced into the forward end of the drum. A burner at the rear end of the drum directs its flame forwardly through an elongated firing tube which extends from the rear end of the drum toward the forward end thereof. The hot gases discharged from the tube strike a baffle, are deflected into an annular chamber between the tube and the drum and then flow rearwardly through the chamber to an exhaust stack. The particulate material also is advanced rearwardly through the chamber and, during such advance, is heated (1) indirectly by the hot gases flowing forwardly through the firing tube and (2) directly by the hot gases deflected into and flowing rearwardly through the chamber.

18 Claims, 7 Drawing Figures

APPARATUS FOR HEATING AGGREGATE, RECYCLED ASPHALT AND THE LIKE

BACKGROUND OF THE INVENTION

This invention relates generally to apparatus for heating particulate material and, more particularly, for heating particulate material which is used on roadways. The apparatus is of the type having an elongated drum adapted to be rotated about its own axis and having a burner at one end of the drum for producing a hot gaseous flame in the drum. Particulate material is introduced into the drum and is advanced from one end of the drum to the other with a tumbling action as the drum is rotated. During such advance, the material is heated by the stream of hot gases from the burner flame.

The particulate material may, for example, be virgin aggregate which is mixed with a binder such as liquid asphalt to produce a bituminous paving material. The aggregate is heated and dried in the drum by the hot gaseous stream and is mixed with the asphalt binder as the aggregate tumbles through the drum. Alternatively, the binder may be added to and mixed with the dried aggregate in a pugmill after the aggregate has been discharged from the drum.

Apparatus incorporating the principles of the invention also may be used to recycle old asphaltic paving material in order to prepare a new mix. In such an instance, the old asphalt is broken up into particulate form, is delivered into the drum, and is rendered plastic and workable by the heat in the drum. Usually, a liquid rejuvenating or softening agent is mixed with the old asphalt, the mixing either taking place in the drum itself or taking place in a pugmill immediately after the asphalt has been discharged from the drum.

It has been recognized that it is desirable to avoid direct exposure of the particulate material to the burner flame or to the hottest portion of the gaseous stream, regardless of whether the particulate material is virgin aggregate or is recycled asphalt. The various problems resulting from such direct exposure are discussed in detail, for example, in Brown U.S. Pat. No. 4,130,364; Schlarmann U.S. Pat. No. 4,165,184; Malbrunot U.S. Pat. No. 4,300,837; Schlarmann U.S. Pat. No. 4,318,619 and Malipier et al U.S. Pat. No. 4,318,620.

It also has been recognized that control must be maintained over pollution of the atmosphere caused by the emission of "fines" from the aggregate or the recycled asphalt. In order to meet the clean air regulations of the Environmental Protection Agency (EPA), many drum-type units must employ an expensive dust collector or precipitator in association with the exhaust stack of the unit. Units which attempt to maintain a "clean" exhaust without the use of a dust collector or the like are disclosed in Shearer U.S. Pat. No. 3,832,201; Shearer U.S. Pat. No. 4,025,057; Benson U.S. Pat. No. 4,229,109 and Graham U.S. Pat. No. 4,249,890.

SUMMARY OF THE INVENTION

The general aim of the present invention is to provide a new and improved drum-type heating unit in which the flow of particulate material and hot gases through the drum is effected in a unique manner in order to promote efficient heating of the material, to avoid direct contact of the material with the burner flame and to reduce the escape of fines and other pollutants into the atmosphere.

A further object of the invention is to provide a unit which may be used equally well with either virgin aggregate or recycled asphalt and which is capable of mixing the selected material with a binder or softening agent either in the drum itself or in a pugmill at the outlet end of the drum.

A more detailed object is to provide a drum-type heating unit in which a burner is located adjacent the outlet end of the drum and directs its flame in one direction down an elongated firing tube which extends along the center of the drum. A baffle is located adjacent the discharge end of the firing tube and deflects the hot gases into an annular chamber which is defined between the tube and the drum, the gases flowing reversely through the chamber and being discharged through an exhaust stack at the outlet end of the drum. Particulate material is introduced into the inlet end of the drum (i.e., the end opposite the burner) and is directed into the annular chamber. The material is advanced through the chamber in the same direction as the reversely flowing gases and ultimately is discharged from the outlet end of the drum.

With the foregoing arrangement, the firing tube shields the particulate material from direct exposure to the hot flame in the tube and yet, at the same time, the flame acts through the tube to indirectly heat the material by conduction. In addition, the material is directly heated by the gases which flow through the annular chamber in the same direction as the material. This not only results in efficient heating of the particulate material but also allows the liquid binder or softening agent to be introduced into and mixed with the material at the inlet end of the drum without being exposed to the flame. Thus, the danger of fire and degradation is avoided and, in addition, the liquid coats the particulate material at an early stage in the drum so as to reduce the emission of dust and fines through the exhaust stack.

Another object of the invention is to provide a drum having novel screen members which grade recycled asphalt and which retard the flow of the asphalt through the drum until the asphalt has been broken down into particles of small size.

The invention also resides in the internal construction of the drum and in the ability to mix sulfur or other additives with the material discharged from the drum.

These and other objects and advantages of the invention will become more apparent from the following detailed description when taken in conjunction with the accompanying drawings.

DETAILED DESCRIPTION OF THE PREFERRED EMBODIMENT

Figure 1:
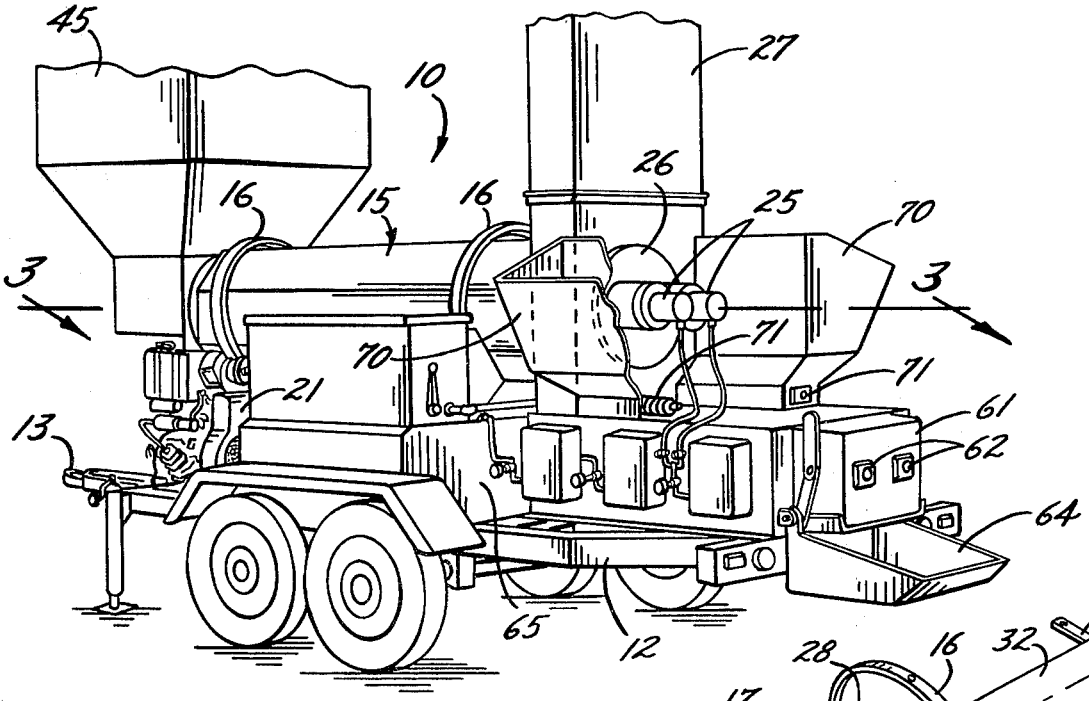
FIG. 1 is a perspective view of new and improved apparatus incorporating the unique features of the present invention.

For purposes of illustration, the invention is shown in the drawings as embodied in apparatus 10 for heating particulate material 11 (FIG. 3) and for preparing such material for use on roadways. The particulate material may, for example, be virgin aggregate (i.e., sand or a mixture of sand and gravel) which may be mixed with a binder such as liquid asphalt to form a bituminous paving material. The particulate material alternatively may constitute old asphaltic paving material which is ground up and subsequently rejuvenated by the apparatus so that such material may be applied to a roadway as a fresh mix.

The apparatus 10 preferably includes a wheeled trailer 12 having a hitch 13 on its forward end and adapted to be towed forwardly from right to left as viewed in FIG. 1. Supported on the trailer and extending in a fore-and-aft direction is an elongated drum 15 which is adapted to be rotated about its own axis. While the drum could be of circular cross-section, it herein is octogonal in shape and is formed by eight angularly related side walls.

Figure 2:
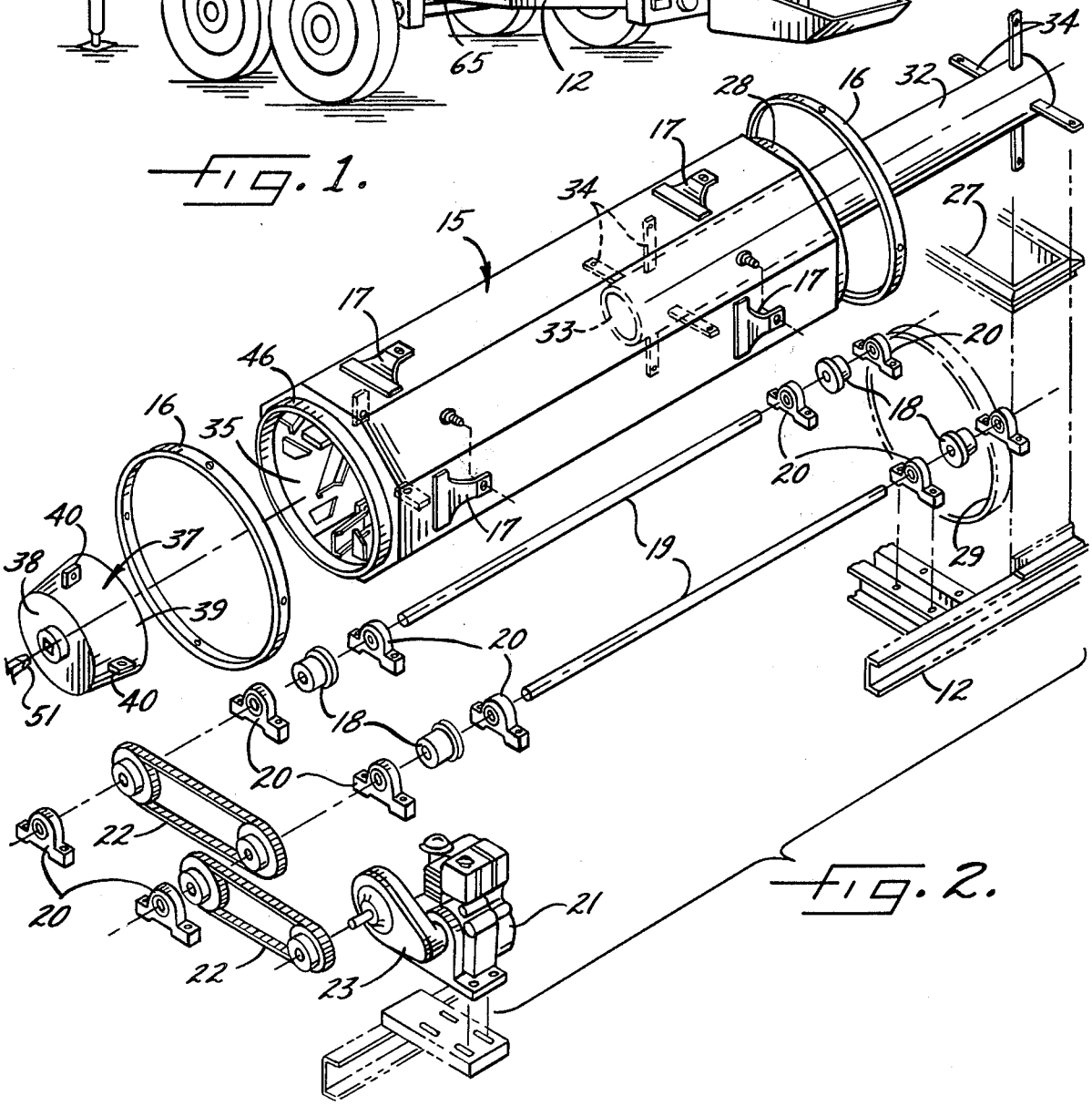
FIG. 2 is an exploded perspective view of the drum and certain parts which are associated with the drum.

Two circular rings 16 (FIGS. 1 and 2) extend around the end portions of the drum 15 and are secured rigidly to brackets 17 on the drum. Each ring is cradled by a pair of laterally spaced rollers 18 (FIG. 2) which are secured to laterally spaced shafts 19, the latter being rotatably supported on the trailer 12 by bearings 20. A gasoline engine 21 also is supported on the trailer and is operably connected to the shafts by chain drives 22. When a clutch 23 which is associated with the engine is engaged, the shafts and the rollers are rotated with the rollers acting against the rings to cause the drum to turn about its own axis. The drum is inclined downwardly and rearwardly at an angle of between, for example, three to five degrees so that material 11 which is deposited into the front end of the drum advances toward the rear end thereof as the drum rotates.

The present invention contemplates the provision of new and improved drum-type heating apparatus 10 which efficiently heats the particulate material 11 with a gaseous flame, which effects such heating without subjecting the material to an open flame or to excessively hot gases and which enables good control of the emission of dust, fines and other pollutants from the apparatus. The apparatus 10 of the invention is particularly characterized by the unique relationship between the flow of the particulate material and the flow of the hot gases to enable the above-described advantages to be attained.

More specifically, the apparatus 10 includes at least one and preferably two L.P. burners 25 (FIGS. 1 and 3) which are located at the rear or outlet end of the drum 15. The burners are supported on a mounting plate 26 which, in turn, is secured to an upwardly extending exhaust stack 27 of rectangular cross-section. The exhaust stack is supported in a stationary position on the trailer 12 and communicates directly with the interior of the drum adjacent the outlet end of the drum. A circular end ring 28 (FIG. 2) on the rear of the drum is rotatably received in a circular opening 29 in the forward side of the stack 27 to permit the drum to rotate relative to the stack.

The flame from the burners 25 is directed into a relatively short combustion tube 30 (FIG. 3) made of refractory material and secured to the exhaust stack 27, the combustion tube projecting a short distance into the central portion of the rear or outlet end of the drum 15. In carrying out the invention, an elongated firing tube 32 made of heat-resistant metal projects forwardly from the combustion tube 30 and extends along the central portion of the drum 15 to a location near the front or inlet end of the drum. The forward or discharge end 33 of the firing tube is open.

Figures 3, 4, 5, 6:
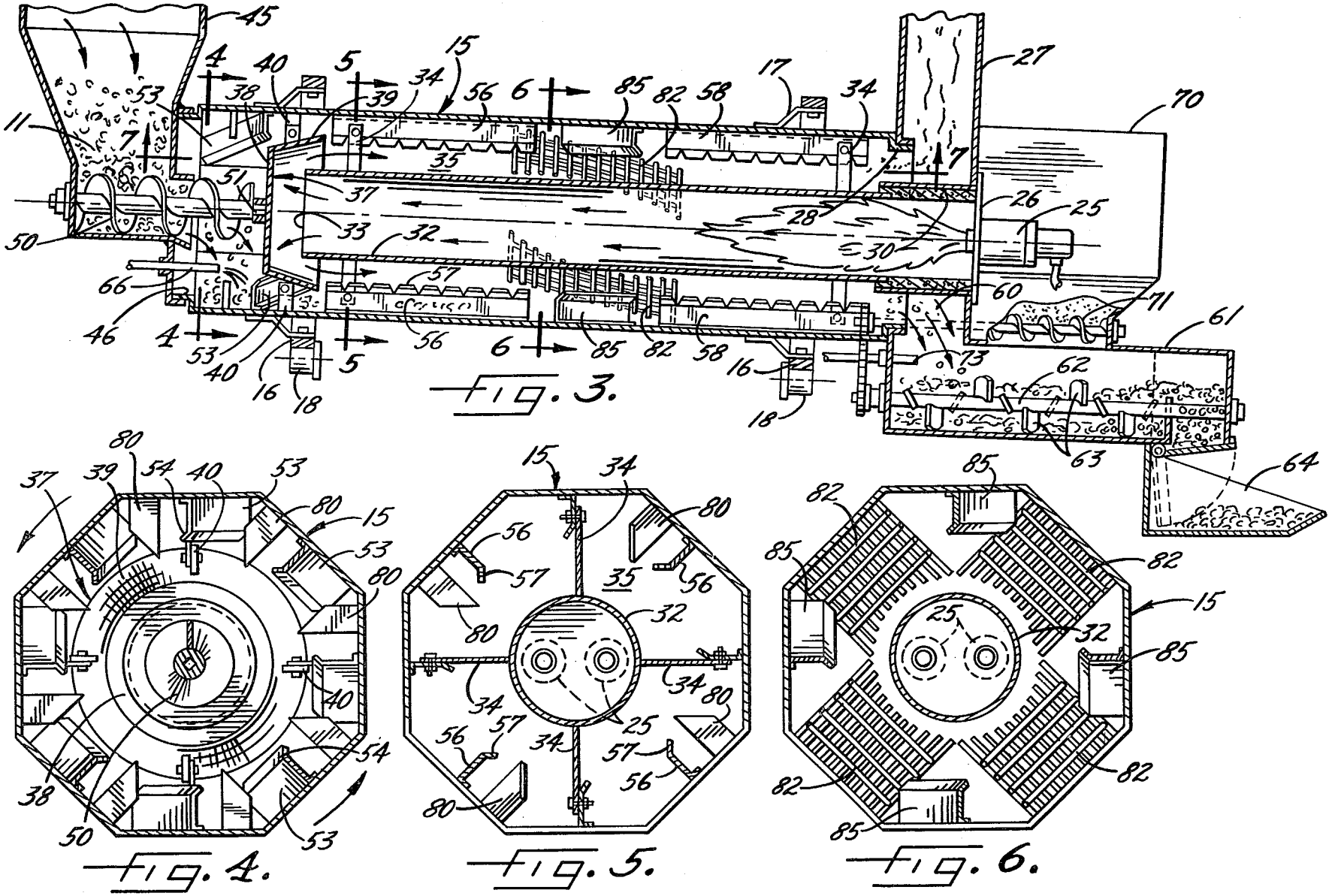
FIG. 3 is an enlarged fragmentary cross-section taken substantially along the line 3—3 of FIG. 1.
FIGS. 4, 5 and 6 are enlarged fragmentary cross-sections taken substantially along the lines 4—4, 5—5 and 6—6, respectively, of FIG. 3.

As shown in FIG. 3, the firing tube 32 is considerably smaller in diameter than the drum 15 and is secured rigidly to the drum by a pair of four-armed spiders 34 which extend radially between the tube and the drum. Thus, the firing tube rotates with the drum. The rear end portion of the firing tube 32 is rotatably received in the forward end portion of the combustion tube 30 to permit the firing tube to turn.

By virtue of the firing tube 32, an annular chamber 35 (FIGS. 3 and 5) of substantial radial width is defined between the outer side of the tube and the inner side of the drum 15 and extends from the rear end of the drum throughout a substantial length thereof. Pursuant to the invention, the hot gases created by the flame and flowing forwardly (i.e., from right to left in FIG. 3) through the firing tube 32 are discharged therefrom and are immediately deflected along a reverse course through the chamber 35 from the front of the drum 15 toward the rear thereof. For this purpose, a baffle 37 is positioned in front of the discharge end 33 of the firing tube and is located such that hot gases emerging from the tube strike the baffle. In this instance, the baffle is a dish-shaped member having an upright circular wall 38 and having an annular peripheral skirt 39, the latter projecting rearwardly from the margins of the upright wall and being secured rigidly to the drum 15 by brackets 40. The upright wall 38 is disposed in opposing relation with the discharge end 33 of the firing tube 32 and is spaced forwardly a short distance from the discharge end. The skirt 39 extends rearwardly beyond the discharge end of the firing tube 32 and thus the end portion of the tube projects a short distance into the skirt and is shrouded by the skirt. The skirt is spaced radially from the tube and, for a purpose to be explained subsequently, the skirt flares outwardly as the skirt progresses toward the rear or outlet end of the drum 15.

With the foregoing arrangement, the flame and the hot gases shoot into the firing tube 32 and flow from the rear end of the tube to the forward discharge end 33 thereof. The hot gases which shoot out of the tube strike the upright wall 38 of the baffle 37, are deflected toward the skirt 39 and then are deflected and guided by the skirt into the annular chamber 35. The gases then flow through the chamber from the front to the rear thereof (i.e., from left to right in FIG. 3) and are exhausted through the stack 27 at the rear end of the drum 15.

Further in carrying out the invention, the particulate material 11 is introduced into the drum 15 at the forward or inlet end of the drum and is delivered into and advanced through the chamber 35. During such advance, the material is heated in two ways. That is, the material is indirectly heated by conduction by the hot gases flowing through the firing tube 32 in a direction opposite to the direction of advance of the material. In addition, the particulate material is directly heated by the hot gases flowing through the chamber 35 in the same direction that the material is advanced. As a result, the material is heated efficiently by the heat created by the burners 25 and yet, at the same time, the material is not subjected directly to the flame or to the hottest portion of the gas stream since the tube 32 acts as a shield between the flame and the material.

More specifically, the particulate material 11 is stored in a hopper 45 (FIG. 3) which is supported on the trailer 12 adjacent the front end of the drum 15. A circular end ring 46 (FIG. 2) on the front end of the drum is rotatably received by a fixed ring on the hopper in order to support the drum while enabling the drum to turn.

Particulate material 11 in the hopper 45 is metered into the drum 15 by a rotatable auger 50 (FIG. 3) located at the lower end portion of the hopper. A non-circular shaft 51 on the rear end of the auger is non-rotatably connected to the upright wall 38 of the baffle 37 (see FIGS. 2 and 3) and thus the auger is rotated when the drum and the baffle are rotated.

Figure 7:
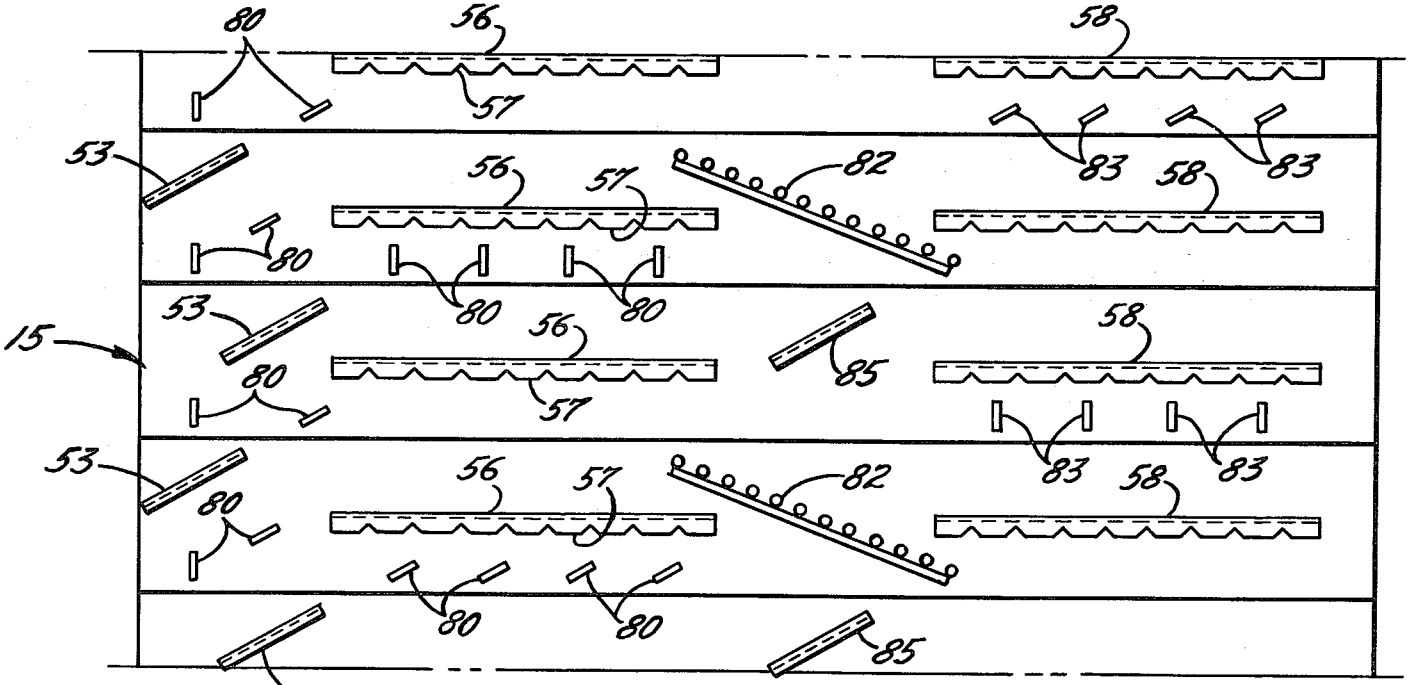
FIG. 7 is a roll-out view which illustrates, somewhat schematically, the interior of a portion of the drum shown in FIGS. 2 and 3.

The material 11 which is delivered into the drum 15 by the auger 50 is picked up by a set of flights 53 (FIGS. 3, 4 and 7) and is advanced into the chamber 35. As shown in FIGS. 3 and 4, the flights 53 are formed by strips of sheet metal and are spaced around the inner wall of the drum 15, each flight having a lip 54 which picks up and then drops the material 11 as the drum rotates. The flights 53 do not extend parallel to the axis of the drum but instead are angled as shown in FIGS. 3 and 7. Accordingly, when the drum is rotated in a counterclockwise direction as viewed in FIG. 4, the flights quickly advance the particulate material in a downstream direction past the baffle 37 and into the chamber 35. Such rapid advance of the material in the upstream portion of the drum causes the material to flow quickly past the hot baffle so that the material will not be degraded by the relatively high temperatures at the baffle. Because the skirt 39 of the baffle enshrouds the discharge end 33 of the firing tube 32, the particulate material is forced to flow into the chamber 35 and is restricted from flowing into the firing tube. Also, the flared shape of the skirt enables any material which might drop into the skirt to gravitate downwardly and forwardly out of the skirt rather than remaining therein and being continuously subjected to the high temperatures in the area of the baffle.

The particulate material 11 which is advanced into the chamber 35 by the flights 53 is picked up and continuously tumbled by an upstream set of flights 56 (FIGS. 3, 5 and 7) spaced angularly around and secured to the inner side of the drum 15. Each of the flights 56 is formed with a serrated lip 57 which first picks up and then drops the material to effect the tumbling action. A second set of flights 58 identical to the flights 56 is located in the downstream portion of the drum. The flights 56 and 58 extend parallel to the axis of the drum and primarily effect tumbling of the material. Advancement of the material past the flights 56 and 58 occurs primarily as a result of the downward and rearward tilt of the drum 15.

As the material 11 advances through the chamber 35, it is heated both directly and indirectly in the manner described above. Upon reaching the outlet end of the drum 15, the material is dumped downwardly through a discharge opening 60 (FIG. 3). A catch pan (not shown) may be located directly beneath the discharge opening 60 to receive the material, the material then being removed from the catch pan and applied to a roadway or delivered to other roadway equipment. Alternatively, and as shown in the drawings, the material dumped from the discharge opening 60 may be delivered to a pugmill 61 for further agitation or mixing. The pugmill includes a pair of power-rotated shafts 62 carrying blades 63 which stir the material and advance the material rearwardly. Upon being discharged from the pugmill, the material is delivered to a catch pan 64 located beneath the pugmill.

The apparatus 10 may be used simply for drying virgin aggregate 11. In most instances, however, the apparatus will be used for preparing hot mix asphalt. In one method of preparing such a mix, virgin aggregate 11 is loaded in the hopper 45 and is delivered into the drum 15. As the aggregate enters the drum, it is coated with hot liquid bituminous binder (e.g., liquid asphalt). The liquid asphalt is contained in a heated tank 65 (FIG. 1) on the trailer 12 and is adapted to be pumped to one or more injection nozzles 66 (FIG. 3) located at the inlet end of the drum 15 and positioned upstream of the baffle 37. The liquid asphalt immediately coats the aggregate and prevents any significant amounts of dust and fines from being released from the aggregate as the aggregate proceeds through the chamber 35. As a result, the exhaust from the stack 27 is sufficiently clean to meet E.P.A. standards without need of directing the exhaust to a dust collector or other expensive pollutant removing apparatus. Because the baffle 37 shields the extreme upstream end of the drum 15 from the flame and the hottest gases, the liquid asphalt may be injected into the extreme upstream end portion of the drum without danger of the liquid asphalt being ignited or degraded. Also, the asphalt-coated aggregate is quickly advanced past the baffle 37 and is shielded from the flame by the tube 32 and thus the coated aggregate is not subjected to detrimentally high temperatures.

When the liquid asphalt is injected into the drum 15 through the nozzles 66, such asphalt becomes thoroughly mixed with the aggregate as the materials proceed through and tumble within the chamber 35. Even if the apparatus 10 is not equipped with the pugmill 61, the material delivered from the discharge opening 60 is sufficiently mixed for use as a hot mix paving material. Additional mixing, however, may be effected by equipping the apparatus with the pugmill 61 and by delivering the material through the pugmill before application to the roadway. Also, the pugmill enables additional material (e.g., sulfur) to be mixed with the material delivered from the drum 15. For example, powdered sulfur may be stored in a hopper 70 (FIGS. 1 and 3) on the rear of the trailer 12 and may be metered into the pugmill by a rotatable auger 71. The sulfur is mixed with the asphalt-aggregate in the pugmill in order to form a paving material known as sulfur extended asphalt.

In some operations (e.g., operations outside of the United States), E.P.A. standards are not applicable and a less clean exhaust from the stack 27 may be tolerated. In such a case, the liquid asphalt from the tank 65 may be injected into the aggregate at the pugmill 61 itself by means of a nozzle 73 (or spray bar) associated with the pugmill as shown in FIG. 3. If the liquid asphalt is injected directly at the pugmill, liquid asphalt is not injected into the upstream end of the drum 15 by way of the nozzles 66. The absence of liquid asphalt in the upstream end of the drum results in a more smoke-free operation and makes the aggregate easier to dry. There is, however, a greater emission of fines and dust since the aggregate is in an uncoated state as it proceeds through the chamber 35.

The particulate material 11 which is delivered into the drum 15 from the hopper 45 may be old asphalt pavement which previously has been ground up into relatively small chunks and particles. As the recycled pavement proceeds through the drum, the heat softens the asphalt binder while the tumbling action re-mixes the binder and the aggregate to produce a fresh paving material. A liquid softening agent (e.g., an aromatic oil) may be injected into the drum at the nozzles 66 to help dissolve, soften and rejuvenate the old material. Because of the tube 32 and the baffle 37, the old material is not subjected to destructively high temperatures. Moreover, the aggregate particles which proceed through the drum are coated by and encased in the softened asphalt and thus a dust collector to control emissions is not necessary. If the apparatus is equipped with the pugmill 61, the rejuvenating agent may be injected through the nozzles 73 instead of the nozzles 66.

In some cases, the old pavement which is delivered to the hopper 45 may not have been ground up into sufficiently small particles to effect complete rejuvenation and to effect the production of a homogeneous mixture. To help break up any large chunks of asphalt, blade-like members 80 (FIGS. 5 and 7) are attached to and are spaced angularly around the drum 15 in the vicinity of the flights 53 and 56. As the flights 56 cause the material to tumble within the drum, the material drops onto the blades 80 so that any larger chunks are broken up into smaller particles.

In accordance with another aspect of the invention, means are provided for restricting the flow of large chunks of material through the chamber 32 until such chunks have been broken up into acceptably small particles. Herein, these means comprise a set of four grid or screen-like members 82 (FIGS. 3, 6 and 7) spaced angularly around the drum 15 and located between the flights 56 and 58. Each of the present grids 82 is formed by two sets of bars welded together and extending generally at right angles to one another. Openings are defined between the various bars and allow smaller particles to pass through the grids while blocking the passage of larger chunks.

Each grid 82 is disposed at an angle such that the grid slopes downwardly and inwardly as the grid progresses in a rearward direction. As the material proceeds through the chamber 35, small particles pass through the openings in the grids and advance to the discharge opening 60. Larger chunks, however, are blocked by the grids and fall back onto some of the blades 80, the latter acting to break up the chunks. Angled flights 85 which are similar to the flights 53 are positioned adjacent the grids to pick up the chunks and re-advance the material toward the grids. Once the chunks have been broken down, the particles pass through the grids and proceed to the discharge opening 60. Thus, the grids serve to "grade" the material to prevent large chunks from passing through the chamber 35. Additional blades 83 (FIG. 7) similar to the blades 80 may be located downstream of the grids 82 to further reduce the size of the particles as the latter are tumbled by the flights 58.

We claim:

1. Apparatus for heating particulate material, said apparatus comprising an elongated drum having inlet and outlet ends, means for rotating said drum about its own axis, an elongated firing tube disposed centrally within said drum, said tube extending from the outlet end of the drum toward the inlet end of the drum and having a discharge end located adjacent the inlet end of the drum, the outer wall of said tube being spaced inwardly from the inner wall of said drum whereby an annular chamber is defined between said tube and said drum, a burner located adjacent the outlet end of said drum and positioned to direct a gaseous flame into the adjacent end portion of said tube, the hot gases from said flame flowing within said tube in a direction extending from the outlet end of the drum toward the inlet end of the drum and being directed out of the discharge end of said tube, means located adjacent the discharge end of said tube for directing the hot gases from said tube into said annular chamber and for causing said gases to flow within said chamber from the inlet end of said drum toward the outlet end thereof, means adjacent the inlet end of said drum for delivering particulate material into said chamber, means located between said drum and said tube for causing said material to tumble within said chamber as an incident to rotation of said drum, said material and said gases moving in the same direction through said chamber with said material being indirectly heated during such movement by the hot gases flowing in said tube and being directly heated by the hot gases flowing in said chamber, an upwardly extending exhaust stack adjacent the outlet end of said drum for receiving hot gases from said chamber and for effecting upward discharge of such gases, and a discharge opening adjacent the outlet end of said drum for discharging the heated material out of said chamber.

2. Apparatus for heating particulate material, said apparatus comprising an elongated drum having inlet and outlet ends, means for rotating said drum about its own axis, an elongated firing tube disposed centrally within said drum, said tube extending from the outlet end of the drum and having a free end located short of the inlet end of the drum, the outer wall of said tube being spaced inwardly from the inner wall of said drum whereby an annular chamber is defined between said tube and said drum, a burner located adjacent the outlet end of said drum and positioned to direct a gaseous flame into the adjacent end portion of said tube, the hot gases from said flame flowing in one direction within said tube and being discharged from the free end thereof, a baffle located within said drum adjacent the inlet end of the drum, said baffle being positioned in spaced opposing relation with the free end of said tube so as to deflect the hot gases from said tube into said annular chamber and to cause said gases to flow in the opposite direction within said chamber from the inlet end of said drum toward the outlet end thereof, means adjacent the inlet end of said drum for delivering particulate material into said chamber, means located between said drum and said tube for causing said material to tumble within said chamber as an incident to rotation of said drum, said material advancing in said opposite direction when said drum is rotated, said material being indirectly heated during such advance by the hot gases flowing in said one direction in said tube and being directly heated by the hot gases flowing in said opposite direction in said chamber, an upwardly extending exhaust stack adjacent the outlet end of said drum for receiving hot gases from said chamber and for effecting upward discharge of such gases, and a discharge opening adjacent the outlet end of said drum for discharging the heated material out of said chamber.

3. Apparatus as defined in claim 2 in which said baffle comprises a dish-shaped member having an upright wall positioned in opposing relation with the free end of said tube and having a generally annular peripheral skirt extending from said wall toward the outlet end of said drum.

4. Apparatus as defined in claim 3 in which said skirt flares outwardly upon progressing toward the outlet end of said drum whereby any particulate material which enters said dish-shaped member tends to gravitate outwardly therefrom along said skirt.

5. Apparatus as defined in either of claims 3 or 4 in which the free end portion of said tube projects into and is shrouded by said dish-shaped member.

6. Apparatus as defined in claim 2 for producing a bituminous paving material, said particulate material being virgin aggregate, and means for injecting hot liquid bituminous binder into said aggregate.

7. Apparatus as defined in claim 6 in which said injecting means are located to inject said binder into said aggregate at a location adjacent the inlet end of said drum.

8. Apparatus as defined in claim 6 in which said injecting means are located to inject said binder into said aggregate at a position disposed between said baffle and the inlet end of said drum.

9. Apparatus as defined in claim 6 further including a pugmill located beneath said discharge opening for receiving and mixing the aggregate discharged from said drum.

10. Apparatus as defined in claim 9 in which said injecting means are located to inject said binder into said aggregate at said pugmill.

11. Apparatus as defined in claim 9 further including a hopper adjacent the outlet end of said drum for storing a supply of sulfur, and means for discharging sulfur from said hopper into said pugmill.

12. Apparatus as defined in claim 2 for producing a bituminous paving material, said particulate material being recycled asphalt, and means for injecting a liquid softening agent into said recycled asphalt.

13. Apparatus as defined in claim 12 in which said injecting means are located to inject said softening agent into said recycled asphalt at a location adjacent the inlet end of said drum.

14. Apparatus as defined in claim 12 in which said injecting means are located to inject said softening agent into said recycled asphalt at a position disposed between said baffle and the inlet end of said drum.

15. Apparatus as defined in claim 12 further including a pugmill located beneath said discharge opening for receiving and mixing the recycled asphalt discharged from said drum.

16. Apparatus as defined in claim 15 in which said injecting means are located to inject said softening agent into said recycled asphalt at said pugmill.

17. Apparatus as defined in claim 15 further including a hopper adjacent the outlet end of said drum for storing a supply of sulfur, and means for discharging sulfur from said hopper into said pugmill.

18. Apparatus as defined in claim 12 further including screen-like means disposed within said drum between the ends thereof for preventing particulate material which exceeds a predetermined size from advancing to said discharge opening.

* * * * *